US008091903B2

(12) United States Patent
Barrott

(10) Patent No.: US 8,091,903 B2
(45) Date of Patent: Jan. 10, 2012

(54) RETRACTABLE WHEEL ASSEMBLY

(75) Inventor: Rex Keith Barrott, Whangarei (NZ)

(73) Assignees: Rex Keith Barrott (NZ); Jenny Grantham (NZ)

( * ) Notice: Subject to any disclaimer, the term of this patent is extended or adjusted under 35 U.S.C. 154(b) by 0 days.

(21) Appl. No.: 12/942,360

(22) Filed: Nov. 9, 2010

(65) Prior Publication Data

US 2011/0148057 A1 Jun. 23, 2011

(30) Foreign Application Priority Data

Dec. 23, 2009 (AU) ..... 2009251118

(51) Int. Cl.
*B62D 61/12* (2006.01)

(52) U.S. Cl. ..... 280/43.17; 280/47.331; 114/344

(58) Field of Classification Search ..... 280/9, 43, 280/43.1, 43.17, 43.22, 43.23, 43.24, 47.331, 280/641, 642; 114/344
See application file for complete search history.

(56) References Cited

U.S. PATENT DOCUMENTS

| | | | | |
|---|---|---|---|---|
| 2,461,609 A | | 2/1949 | Light | |
| 2,996,307 A | * | 8/1961 | Debailleux | 280/656 |
| 3,084,947 A | | 4/1963 | Booth | |
| 3,091,476 A | * | 5/1963 | Blake | 280/43.13 |
| 3,616,474 A | | 11/1971 | Lindblad | |
| 3,831,211 A | * | 8/1974 | Bustamante | 114/344 |
| 3,858,260 A | | 1/1975 | Hanser | |
| 4,036,507 A | | 7/1977 | Henderson | |
| 4,318,196 A | | 3/1982 | Eide | |
| 4,480,578 A | * | 11/1984 | Fisher et al. | 114/344 |
| 4,588,203 A | | 5/1986 | Anderson | |

FOREIGN PATENT DOCUMENTS

| | | |
|---|---|---|
| GB | 2459849 A | 11/2009 |
| KR | 20090030822 A | 3/2009 |

OTHER PUBLICATIONS

Yachtsman Wheels—http://www.marinesafe.com.au/inflatables/wheels/wheels_yachtsman.html (undated but admitted to be prior art).
Pelican Dinghy Dolly—http://www.pelican-case.com/pelican-dinghy-dolly-300.html (undated but admitted to be prior art).
Chandlery "Serious Wheels", Practical Sailor, Feb. 1, 2003, p. 23.

(Continued)

*Primary Examiner* — Frank Vanaman
(74) *Attorney, Agent, or Firm* — Waddey & Patterson, P.C.; Matthew C. Cox; Emily A. Shouse

(57) ABSTRACT

A retractable wheel assembly is provided for coupling to a mounting on an object. The retractable wheel assembly is moveable between one or more extended positions and a retracted position. The retractable wheel assembly is configured to expose a wheel in the extended position(s) and to stow said wheel in the retracted position. The retractable wheel assembly comprises a first wheel strut rotatably mounted at or proximate a first end thereof, a first link arm handle rotatably coupled at or proximate a second end of the first wheel strut, and a first over-centre locking arm rotatably coupled at or proximate a first end to the first link arm handle and rotatably mounted at a second end thereof. The retractable wheel assembly is configured to rotatably couple to the wheel at or proximate the coupling between the first wheel strut and the first link arm handle.

23 Claims, 9 Drawing Sheets

OTHER PUBLICATIONS http://www.smartmarine.co.nz/heavy-duty-folding-dinghy-wheel-set-alloy-p-5853.html (undated but admitted to be prior art).

Plastimo dinghy wheels for pneumatic boats—http://www.marinescene.co.uk/product/3601/plastimo-dinghy-wheels-for-pneumatic-boats (undated but admitted to be prior art).

New Zealand Application No. 582291 Examination Report dated Jan. 5, 2010, 2 pages.

New Zealand Application No. 582291 Examination Response dated Jul. 14, 2010, 2 pages.

New Zealand Application No. 582291 Notice of Acceptance of Complete Specification dated Sep. 7, 2010, 2 pages.

New Zealand Application No. 582291 Claims as Allowed, 14 pages.

* cited by examiner

Fully retracted locked position

Retracted unlocked position

Transitional position

Extended locked position

First and second over centre locking arms combined in U form.

First and second over centre locking arms combined in H form.

RETRACTABLE WHEEL ASSEMBLY

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is hereby incorporated by reference: Australian Patent Application No. 2009251118 filed Dec. 23, 2009.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

This invention relates to a retractable wheel assembly and in particular, although not limited to, a retractable wheel assembly for use with a dinghy or other boat.

Retractable wheel assemblies have a number of design difficulties, mostly relating to the problems of translating a wheel of sufficient size between a compact retracted position and a deployed position quickly, safely and easily while not being visually or physically obtrusive in the retracted position.

Retractable wheel assemblies are of use for a number of purposes and situations. An example of one such use is the attachment of retractable wheel assemblies to the transom of dinghies or other boats, to facilitate movement over land when bringing ashore or launching. Another example is the use of retractable wheel assemblies for retractable luggage wheels. A further example is the use of retractable wheel assemblies to position retractable guides for materials handling.

When used with a dinghy or other boat a number of features would be desirable in the retractable wheel assemblies for the boat to work well on the water and on land.

One such feature is the ability to be able to position the retractable wheel assembly above the line of the hull bottom when retracted so as not to cause drag while the boat is underway in the water.

Another such feature is that the mechanism to deploy the wheel and the wheel itself should be light weight, but strong and rigid when extended to support the weight of the boat.

The wheel should ideally be sufficiently locked in place when in the retracted position so as not to release due to the pounding and vibration of the boat in rough seas when underway.

The wheel should ideally be sufficiently locked in place in the extended position so as to carry the weight of the boat safely when on land.

The retractable wheel assembly should be simple and quick to use by the operator of the boat, when launching from or landing on a shoreline. The operator will often also be operating other equipment such as an outboard motor, sails, or oars when required to retract or extend the wheels; therefore it is advantageous for the retracting and extending mechanisms to be quick and easy to operate preferably by one person and even more preferably using one hand.

Preferably the top of the wheel held by the retractable wheel assembly should not protrude too far above the top of the transom of the boat so as not to restrict the access to or from the boat or impair the normal operation or visually impair the lines of the boat. Yet when the boat is to be used on land, the wheel must be of a suitable size and type to enable easy rolling and adequate ground clearance over a wide variety of surfaces.

A disadvantage of some previous designs has been the height the retractable wheel assembly and wheel has protruded above the top of the transom, hampering normal operation of the boat and visually impairing the boat's lines. One such arrangement is described in U.S. Pat. No. 4,036,507.

Another disadvantage of some previous designs has been the restriction of the type and size of the wheels able to be used due to the design of the mechanism of the retractable wheel assembly thus limiting the type of surface terrain the boat could be easily wheeled over. One such design is described in U.S. Pat. No. 4,588,203.

A further disadvantage of some previous designs has been with locking mechanisms that are difficult to use. A complex design which uses both an over-centre locking mechanism and locking pins is described in U.S. Pat. No. 4,588,203. In this design, a locking pin must be released and transferred between two different apertures and a second locking pin located in a third aperture in order to move the retractable wheel assembly from the locked stowed position to the locked deployed position.

To operate some previous designs with the boat afloat, locking pins must be located in corresponding holes or slots which in some cases are submerged under water. One such design is described in U.S. Pat. No. 4,036,507. To deploy known retractable wheel assemblies with the boat on shore, the retractable wheel mechanism has to be manipulated at the same time as the boat is lifted off the ground; a task often requiring two people to execute safely.

BRIEF SUMMARY OF THE INVENTION

It is an object of the present invention to provide a retractable wheel assembly which will overcome or ameliorate at least one of the above mentioned disadvantages of the prior art, or at least provide the public with a useful choice.

According to a first aspect of the invention, there is provided a retractable wheel assembly for coupling to a mounting on an object, the retractable wheel assembly being moveable between one or more extended positions and a retracted position, wherein in the extended position(s) the retractable wheel assembly is configured to expose a wheel and to stow said wheel in the retracted position, the retractable wheel assembly comprising:

a first wheel strut rotatably coupled to a first mounting at or proximate a first end thereof;

a first link arm handle rotatably coupled at or proximate a second end of the first wheel strut and a first over-centre locking arm rotatably coupled at or proximate a first end to the first link arm handle and rotatably coupled to a second mounting at or proximate a second end thereof, wherein the retractable wheel assembly is configured to rotatably couple to the wheel at or proximate the coupling between the first wheel strut and the first link arm handle, wherein the retractable wheel assembly is configured such that the first over-centre locking arm moves in first and second directions about the second mounting as the assembly is moved between the extended and retracted positions, and wherein the first and second directions are substantially opposing.

Preferably the retractable wheel assembly is configured to expose a wheel. While embodiments of the invention are generally described as comprising a wheel, the invention is not limited thereto and may alternatively be configured to selectively expose a roller, ski, track or other device to enable transport of the object or as a guide, such as for materials handling.

Preferably the retractable wheel assembly comprises said wheel.

Preferably the retractable wheel assembly comprises an elastic means arranged to releasably lock the retractable wheel assembly in the retracted position.

Preferably the elastic means comprises at least a portion of the wheel.

In a preferred configuration deformation of the wheel provides the elastic means. The wheel may be made of a material which provides a force against deformation such as rubber, or comprise an inflated tire, inflated to an extent where such a force will be present. Alternatively the elastic means may be provided by a spring or other elastic member coupled in a configuration to releasably maintain the retractable wheel assembly in the retracted position.

According to an alternative embodiment, the elastic means is integral or coupled to the first wheel strut and/or the first link arm handle and could provide shock absorbing suspension when the mechanism is in the extended position. For example a torsion spring could be provided at the coupling between the first wheel strut and the first link arm handle. While inclusion of the elastic means is generally preferred in situations where there is excessive vibration or where a stronger lock in the retracted position is required, it is not essential as the apparatus will lock in the retracted position without the elastic means.

The force generated by the elastic means preferably acts against the mountings for the first over-centre locking arm and the first wheel strut.

Preferably the retractable wheel assembly comprises a common axle or axis of rotation for the wheel coupling and the coupling between the first wheel strut and the first link arm handle.

Preferably the first mounting is fixed spatially relative to the second mounting.

Preferably the coupling between the first link arm handle and the first over-centre locking arm is below a reference line extending through the second mounting and the coupling between the first wheel strut and the first link arm handle when in the retracted position and wherein in use, the second mounting is positioned above the first mounting.

This configuration provides for the over-centre locking in the retracted position.

Preferably when the retractable wheel assembly is moved out of the retracted position to the extended position(s) the angle between the points defined by:

the rotational coupling between the mounting of the first over-centre locking arm, the rotational coupling between the first wheel strut and the first link arm handle, and the rotational coupling between the first link arm handle and the first over-centre locking arm, moves from being greater than substantially 180° to less than substantially 180°.

Preferably when the retractable wheel assembly is moved into the retracted position from the extended position(s) the angle between the points defined by:

the rotational coupling between the mounting of the first over-centre locking arm, the rotational coupling between the first wheel strut and the first link arm handle, and the rotational coupling between the first link arm handle and the first over-centre locking arm, moves from being less than substantially 180° to greater than substantially 180°.

Preferably when the retractable wheel assembly is moved between the retracted position and the extended position(s) the angle between the points defined by:

the second mounting, the rotational coupling between the first wheel strut and the first link arm handle, and the rotational coupling between the first link arm handle and the first over-centre locking arm, moves from being greater than substantially 180° to less than substantially 180° or less than substantially 180° to greater than substantially 180°.

Preferably when in the retracted position the first wheel strut abuts the first over-centre locking arm thereby limiting further travel of the first link arm handle.

Additionally or alternatively protrusions such as pins may be mounted on or integral to the first over-centre locking arm that in the retracted position abut the first link arm handle, thereby limiting further travel of the first link arm handle.

Alternatively the protrusions may be provided on the first link arm handle and configured to abut the first over-centre locking arm. Alternative arrangements will also be apparent to those skilled in the art and are included within the invention.

Preferably the retractable wheel assembly comprises a means for releasably securing the retractable wheel assembly in the extended position(s).

Preferably the means for releasably securing the retractable wheel assembly in the extended position(s) comprises a first rotatably mounted catch configured to engage a locking means.

Preferably the first rotatably mounted catch comprises one or more notches configured to engage one or more locking pins of the locking means.

Preferably the one or more locking pins are coupled to or integral to the first over-centre locking arm.

Preferably said locking pin(s) are configured to act as said protrusions when in the retracted position.

Preferably the means for releasably securing the retractable wheel assembly in the extended position(s) is biased.

Preferably the means for releasably securing the retractable wheel assembly in the extended position(s) is spring biased.

Preferably the means for releasably securing the retractable wheel assembly in the extended position(s) is rotatably coupled on a common axis of rotation as the first mounting.

Preferably the means for releasably securing the retractable wheel assembly in the extended position(s) is configured to be released with one hand.

Preferably the means for releasably securing the retractable wheel assembly in the extended position(s) is configured to be released with one hand while substantially simultaneously moving the retractable wheel assembly into the retracted position with the same hand.

While such means for releasably securing the wheel in the extended position are preferred, the invention is not limited thereto.

Preferably the retractable wheel assembly comprises a mounting bracket adapted to mount the retractable wheel assembly on an object. As indicated elsewhere herein components of the bracket may be incorporated in the object to which the retractable wheel assembly is mounted.

Preferably the mounting bracket is configured to mount to or include the first and second mountings.

Preferably, in the retracted position, the wheel abuts the mounting bracket. Where the mounting bracket is omitted, the wheel may abut the surface of the object to which the retractable wheel assembly is mounted.

Preferably the mounting bracket has at least one outstanding surface.

Preferably the outstanding surface(s) is adapted for mounting of the first over-centre locking arm and/or the first wheel strut.

Preferably the retractable wheel assembly comprises a second wheel strut rotatably mounted at or proximate a first end thereof.

Preferably the second wheel strut is rotatably mounted on the mounting bracket.

Preferably the second wheel strut is rotatably mounted on at least one of the outstanding surfaces of the mounting bracket.

Preferably the second wheel strut is substantially parallel to the first wheel strut.

Preferably the retractable wheel assembly comprises a second link arm handle.

Preferably the second link arm handle is integral to the first link arm handle.

Preferably the first and second link arm handles form a substantially U-shaped member.

Preferably the second link arm handle is rotatably coupled to the second wheel strut.

Preferably the couplings between:

the first wheel strut and the first link arm handle; and the second wheel strut and the second link arm handle;

are on a common axle or axis of rotation.

Preferably the wheel is rotatably coupled at the common axle or axis of rotation.

According to one embodiment the mountings of the first and second wheel struts are on a common axle or axis of rotation. Alternatively each wheel strut may be independently mounted, but preferably have a common axis of rotation.

Preferably the first rotatably mounted catch is rotatably coupled on the common axle or axis of rotation of the mountings of the first and second wheel struts.

Preferably the retractable wheel assembly comprises a second over-centre locking arm rotatably mounted at a second end thereof.

Preferably the second over-centre locking arm is rotatably coupled at or proximate a first end thereof to the second link arm handle.

Alternatively the second over-centre locking arm is rotatably coupled at or proximate a first end to the first link arm handle. Wherein the second over-centre locking arm may be in a substantially L shaped form.

Alternatively the second over-centre locking arm is rotatably coupled at or proximate a first end to the first link arm handle and a first end to the second link arm handle. Wherein the first and second over-centre locking arms may be combined in a substantially U or H shaped member.

Preferably the second over-centre locking arm is rotatably mounted on the mounting bracket.

Preferably the second over-centre locking arm is rotatably mounted on at least one of the outstanding surfaces of the mounting bracket.

Preferably the second over-centre locking arm is substantially parallel to the first over-centre locking arm.

Preferably the retractable wheel assembly comprises a second rotatably mounted catch.

Preferably the second rotatably mounted catch is integral to the first rotatably mounted catch.

Preferably the first and second rotatably mounted catch form a substantially U-shaped member.

Preferably the second rotatably mounted catch is rotatably coupled on the same axle or axis of rotation as the mountings of the second wheel strut.

Preferably the retractable wheel assembly comprises

- a second wheel strut rotatably mounted at or proximate a first end thereof, and configured to cooperate with the first wheel strut to improve structural rigidity, and/or
- a second link arm handle configured to cooperate with the first link arm handle to improve structural rigidity, and/or
- a second over-centre locking arm rotatably mounted at or proximate one end thereof and configured to cooperate with the first over-centre locking arm to improve structural rigidity, and/or
- a second rotatably mounted catch to improve structural rigidity and engagement with the locking means.

Preferably the second wheel strut is substantially parallel to the first wheel strut and/or the second link arm handle is substantially parallel to the first link arm handle and/or the second over-centre locking arm is substantially parallel to the first over-centre locking arm and/or the second rotatably mounted catch is substantially parallel to the first rotatably mounted catch, with respective same or corresponding couplings provided therebetween.

More preferably the second link arm handle is integral to the first link arm handle preferably forming a substantially U-shaped member and/or the second rotatably mounted catch is integral to the first rotatably mounted catch preferably forming a substantially U-shaped member and/or the second over-centre locking arm is integral to the first over-centre locking arm preferably forming a substantially U or H-shaped member.

Preferably the wheel is at least partly contained within the wheel strut(s), locking arm handle(s) and over-centre locking arm(s).

Further features of the second wheel strut and/or the second link arm handle and/or the second over-centre locking arm and/or the second catch are analogous to features of the first said members. Generally, the second said members preferably operate in parallel with the first said members, providing the retractable wheel assembly with additional strength and rigidity.

According to a second aspect there is provided a retractable wheel assembly for coupling to a mounting on an object, the retractable wheel assembly being moveable between one or more extended positions and a retracted position, wherein in the extended position(s) the retractable wheel assembly is configured to expose a wheel and to stow said wheel in the retracted position, the retractable wheel assembly comprising:

- a plurality of rotatably coupled members;
- wherein in the retracted position the wheel is at least partly contained within the members.

According to preferred embodiments, when at least partly contained within the members, at least first and second portions of the wheel are substantially overlaid by said members, wherein the first portion is substantially diametrically opposed to the second portion.

Preferably the first portion is substantially overlaid by but spaced apart from the first link arm handle.

Preferably the second portion is substantially overlaid by the mounting bracket or the surface of the object to which the retractable wheel assembly is coupled.

Preferably the second portion of the wheel abuts the mounting or the surface of the object to which the retractable wheel assembly is coupled.

Partial enclosure of the wheel within the framework serves to protect and minimise the obstruction caused by the wheel in the retracted position.

Further features of the second aspect may be drawn from and are analogous to the features of the first aspect.

Preferably the retractable wheel assembly according to the first or second aspects is configured to be moved between the extended and retracted positions using a single hand.

According to a third aspect there is provided an article or object comprising a retractable wheel assembly according to the first or second aspect.

According to a fourth aspect there is provided an article or object configured to have a retractable wheel assembly according to the first or second aspect mounted thereto.

According to a fifth aspect there is provided a mounting for a retractable wheel assembly according to the first or second aspect.

BRIEF DESCRIPTION OF THE SEVERAL VIEWS OF THE DRAWINGS

One or more embodiments of the invention will be described below by way of example only and without intending to be limiting with reference to the following drawings, in which.

DETAILED DESCRIPTION OF THE INVENTION

According to one embodiment, the invention may broadly be said to consist of a retractable wheel assembly that is configured to, in use, provide for movement of a wheel engaged therewith through an arc of travel from a retracted position, where the retractable wheel assembly is locked with an over-centre action, to an extended position, where the retractable wheel assembly is locked with a catch.

Such an arrangement provides a retractable wheel assembly which is compact, simple to operate and light in weight, yet is strong enough to carry the weight of the object it is mounted to, for example a boat, off the ground when in the extended position.

The geometry of the mechanism allows a relatively large wheel to be used providing good ground clearance and low rolling resistance yet while in the retracted position allows the wheel to be of minimal obstruction.

The over-centre action locks the wheel in the retracted position.

Deployment and retraction between the extended and retracted positions needs only simple, quick, one handed operations.

Figure 1:
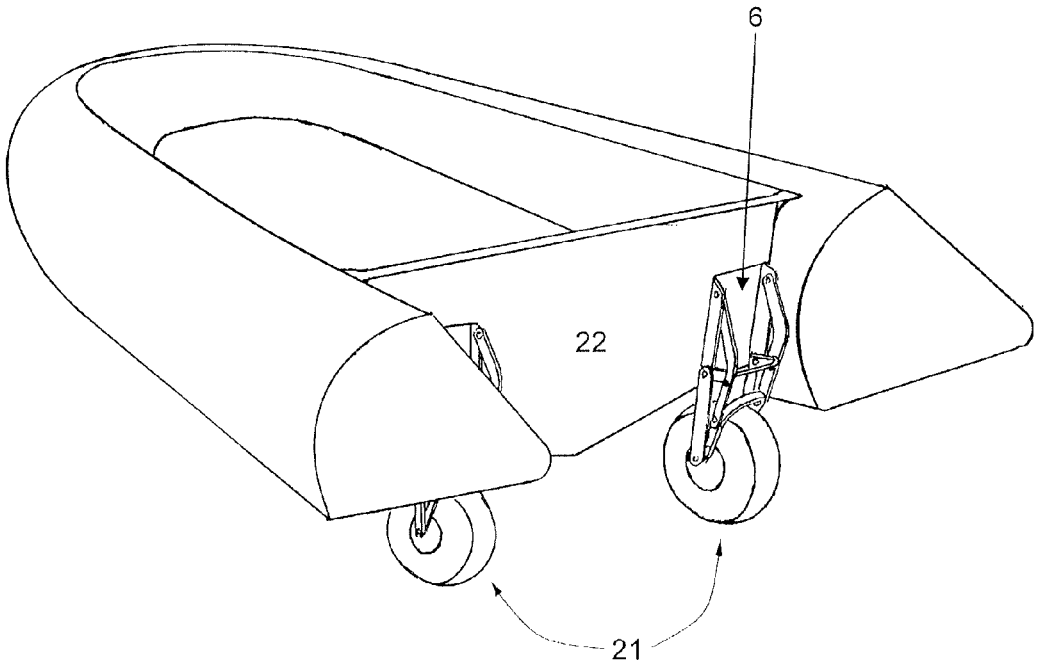
FIG. 1 is a perspective view of an embodiment of a pair of retractable wheel assemblies mounted on the transom of a boat.

With reference to FIG. 1, two retractable wheel assemblies 21 are shown with coupled wheels. In a preferred embodiment, the retractable wheel assembly can be mounted to the transom 22 of a boat or other object via an optional mounting bracket 6. The retractable wheel assembly can also be mounted to the transom of a boat or other object by alternative mounting means, without the use of a mounting bracket. The mounting bracket 6, if present, is fixed to the object by any convenient means such as, but not limited to, bolt and nuts, screws, welding, adhesive and the like, and is adapted for such mounting by, for example, holes in appropriate positions for bolt and nut or screw attachment, or made of appropriate material for welding or adhesive attachment. It is preferred the mounting bracket 6, or other mounting means, is fixed to the transom of a boat above the hull bottom of the boat so as not to cause drag when the retractable wheel assembly is in the retracted locked position and the boat is underway in the water.

Figure 2:
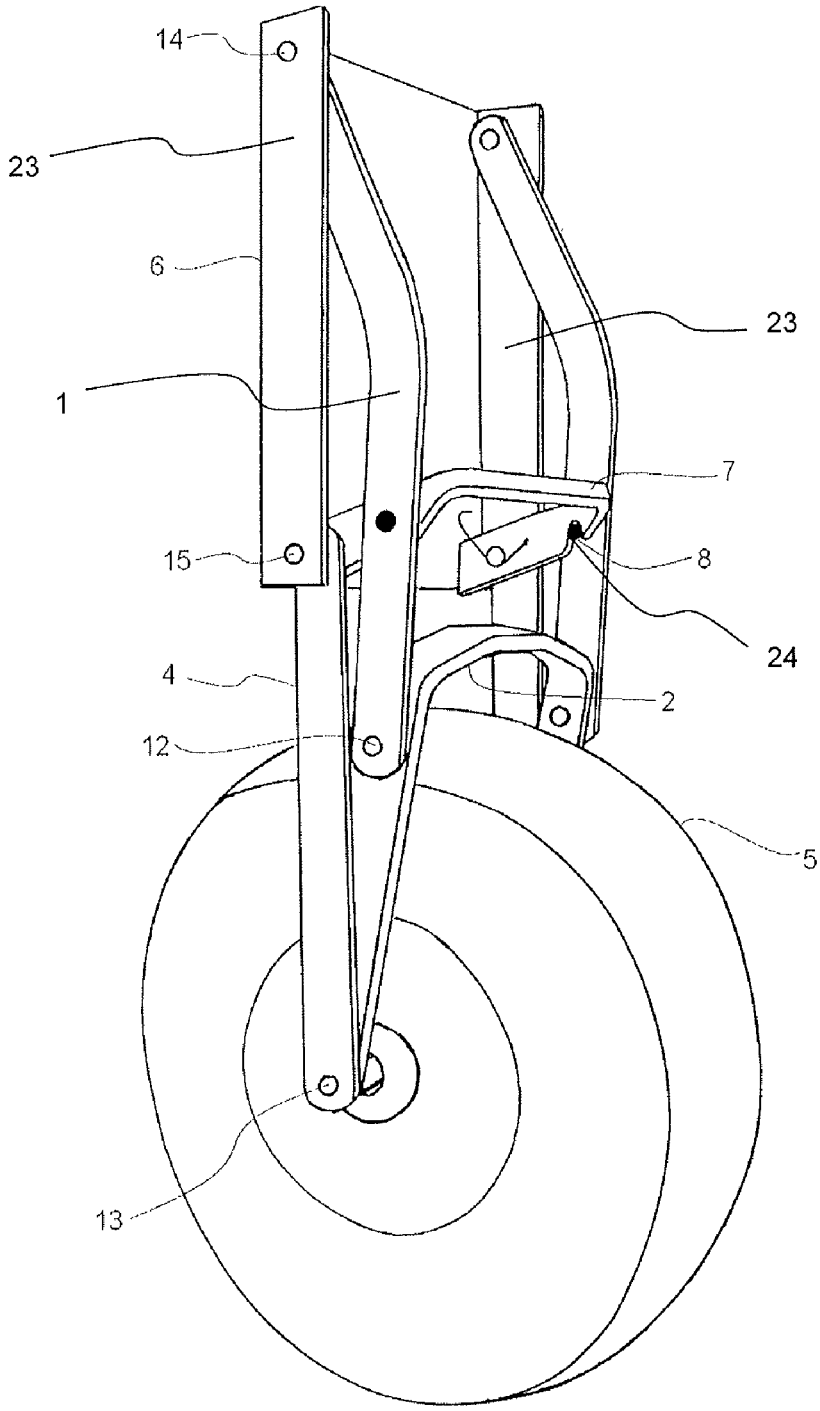
FIG. 2 is a perspective view of one of the retractable wheel assemblies of FIG. 1 in an extended locked position.

With reference to FIG. 2 the retractable wheel assembly comprises an optional mounting bracket 6 for attachment of the retractable wheel assembly to the object on which it is to be used, typically a boat. A first end of a first wheel strut 4 is rotatably coupled, at a first coupling point 15, to the mounting bracket or other mounting means. A first link arm handle 2 is rotatably coupled at a second coupling point 13 to the first wheel strut 4, preferably proximate a second end thereof. The second coupling point 13 is spaced apart from said first coupling point, preferably by a distance greater than the relevant wheel radius. A wheel 5, when present, is rotatably coupled proximate the second end of the first wheel strut 4, preferably in the proximity of or at, the second coupling point 13. The first link arm handle 2 is rotatably coupled at a third coupling point 12 proximate to a first end of a first over-centre locking arm 1. The first over-centre locking arm 1 is rotatably coupled proximate a second end thereof to the mounting bracket 6 or other mounting means, at a fourth coupling point 14.

In a preferred embodiment, as shown in FIGS. 1 and 2, the wheel struts 4 can be used in pairs to allow a wheel 5, when present, to be coupled at the second coupling point 13, between the wheel struts 4. Preferably the over-centre locking arm 1 and/or the link arm handle 2 may also be used in pairs.

Preferably, the second link arm handle is coupled or integral to the first link arm handle.

Further features of the second wheel strut and/or the second link arm handle and/or the second over-centre locking arm are analogous to features of the first said members. For example, there are analogues first coupling points 15, second coupling points 13 and third coupling points 12 between the second wheel strut, second link arm handle and second over-centre locking arm.

The wheel, when present, preferably rotates about an axle. This axle preferably provides part of the coupling of the second coupling point 13. In the embodiment where a single wheel strut 4 is used, a stub axle may be used to couple the wheel 5, when present, to the first wheel strut 4. A wheel 5, when present, may also be rotatably coupled to the wheel strut(s) 4 without the use of an axle. The use of pairs of wheel struts, over-centre locking arms, and link arm handles has been found to give more rigidity to the structure when used in situations that require more strength and durability in the retractable wheel assembly.

In the preferred embodiment as shown, the pair of wheel struts are substantially parallel and the pair of over-centre locking arms are substantially parallel. The use of an axle that fully traverses the gap between the wheel struts at the second coupling points 13, is preferred because it has also been found to give greater stability to the structure and allows better alignment of the wheel struts. In the embodiment shown in FIG. 2, where pairs of wheel struts and over-centre locking arms are used, the integral pair of link arm handles is rotatably coupled at each of the second coupling points 13 on each wheel strut so that the pair of link arm handles bridges or links the wheel struts. The integral pair of link arm handles 2 are also rotatably coupled at each of the third coupling points 12 on each over-centre locking arm 1 so that the integral pair of link arm handles 2 bridges or links the over-centre locking arms 1.

The mounting bracket 6, when present, preferably has at least one outstanding surface 23. In the preferred embodiment shown the mounting bracket has two outstanding surfaces. The outstanding surface(s) includes means for rotatably coupling the wheel strut(s) 4 at the first coupling point(s) 15 and rotatably coupling the over-centre locking arm(s) 1 at the fourth coupling point(s) 14. When pairs of wheel struts and over-centre locking arms are used the first coupling points 15 on each outstanding surface are horizontally aligned with each other and the fourth coupling points 14 on each outstanding surface are also horizontally aligned with each other.

Figure 6:
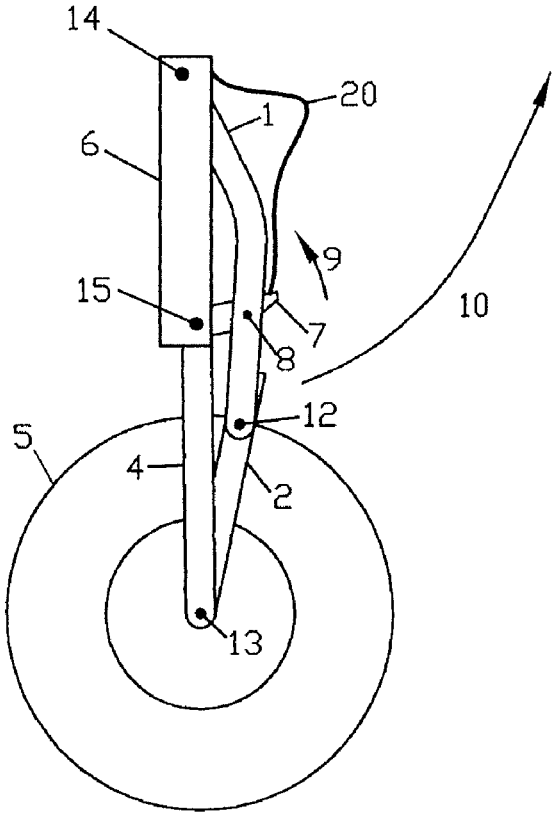
FIG. 6 is a side view of the retractable wheel assembly of FIG. 2 with an optional lanyard.
Figure 7:
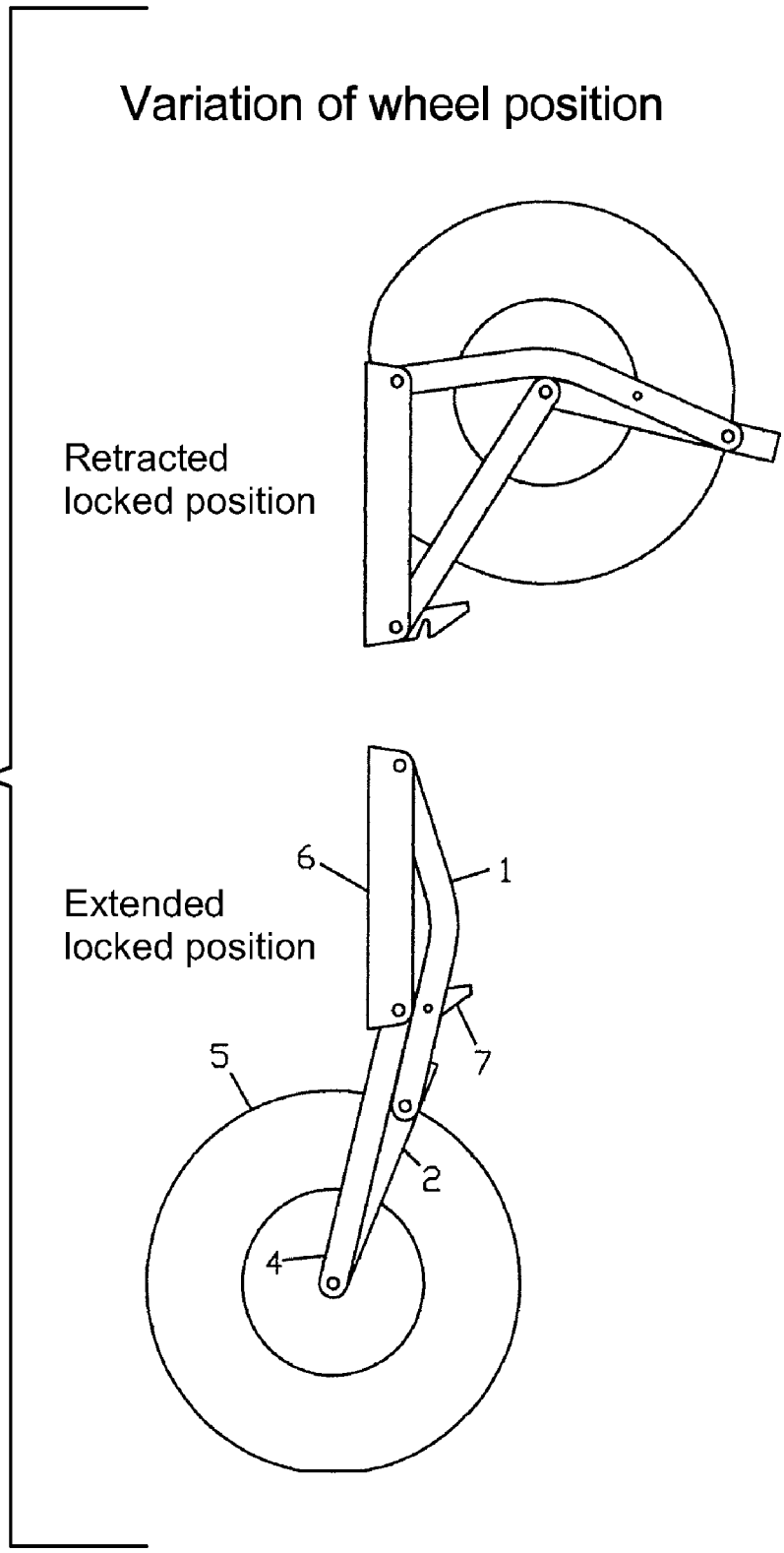
FIG. 7 is a side view of a retractable wheel assembly according to an alternative embodiment which shows an alternative extended position.
Figure 8:
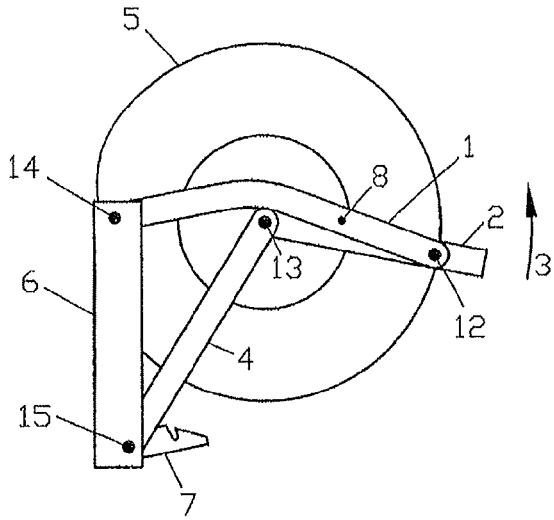
FIG. 8 is a side view of the retractable wheel assembly shown in a fully retracted locked position according to an alternative embodiment of a locking means for securing the assembly in the extended position.
Figure 9:
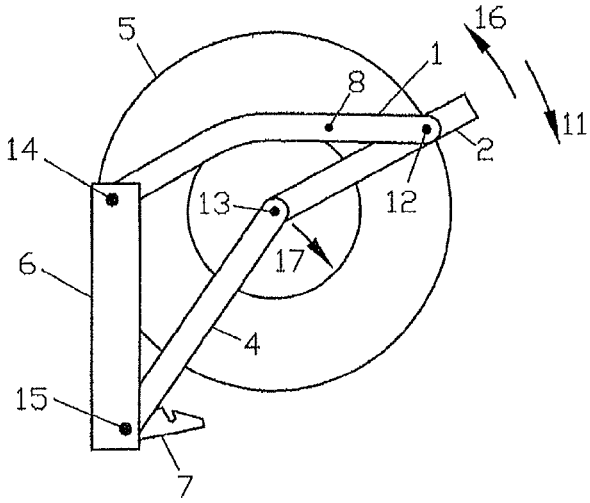
FIG. 9 is a side view of the retractable wheel assembly of FIG. 8 shown in a retracted but unlocked position.
Figure 10:
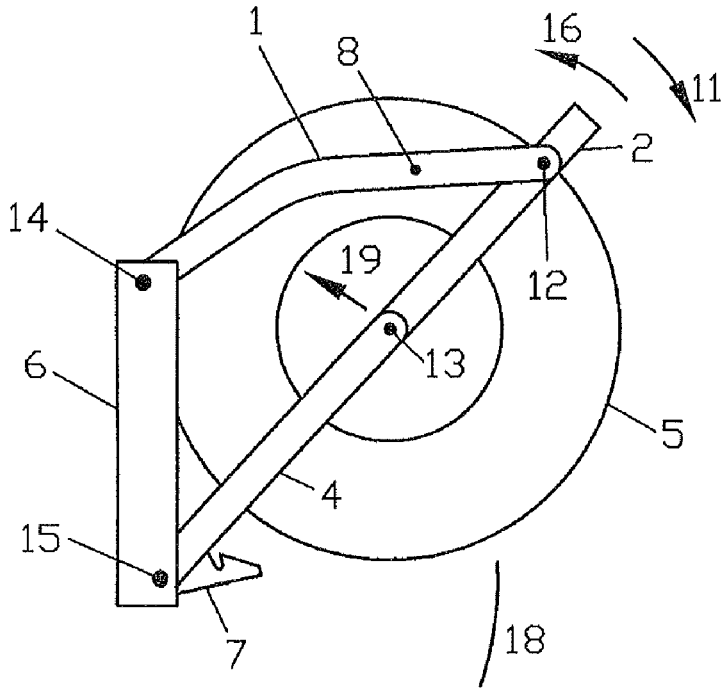
FIG. 10 is a side view of the retractable wheel assembly of FIG. 8 shown in a transitional position (partly extended or retracted).

Means 7, 8, and 24 are provided to releasably secure the retractable wheel assembly in the extended position. Preferably the means comprises a rotatably mounted catch. Pairs of rotatably mounted catches may also be used. In a preferred form, the second catch is coupled or integral to the first catch. In the preferred embodiment shown in FIG. 2, the releasable locking means is provided by an integral pair of catches 7 which are rotatably coupled to the mounting bracket 6, when present, or wheel strut(s) 4, preferably at the first coupling point 15. Notches 24 in the catch(es) 7 engage with locking pin(s) 8 attached to the over-centre locking arm(s) 1. In an alternative preferred embodiment shown in FIG. 8, the notches are shown in an alternative position in the catch(es). The locking means may be gravity operated or biased using, for example, spring loading or other means. While wheel struts 4 are shown being independently rotatably coupled to the mounting bracket 6, it will be appreciated that a common axle may be used, which may also serve to improve the rigidity of the arrangement. This also applies to the third and fourth couplings 12, 14. Also, the locking pin(s) 8 could be configured to span from the first over-centre locking arm to the second over-centre locking arm. As will be appreciated, the dimensions of the elements of the retractable wheel assembly and/or the wheel may be varied if required. The use of an axle provides more stability to the retractable wheel assembly and greater ease of alignment between the pair of wheel struts, when present. FIG. 6 shows the retractable wheel assembly in the extended locked position. FIG. 7 shows the retractable wheel assembly in an alternative extended locked position where the wheel is locked in an alternate position relative to the mounting bracket. One or more notches 24 in the catch 7 allow the retractable wheel assembly to be locked in alternate positions when in the extended position. The provision of more than one notch enables the retractable wheel assembly to be locked in different configurations. In the configuration of FIG. 7, the wheel is positioned to be underneath the object to a greater extent, thereby taking a greater portion of the load of the object.

Figure 11:
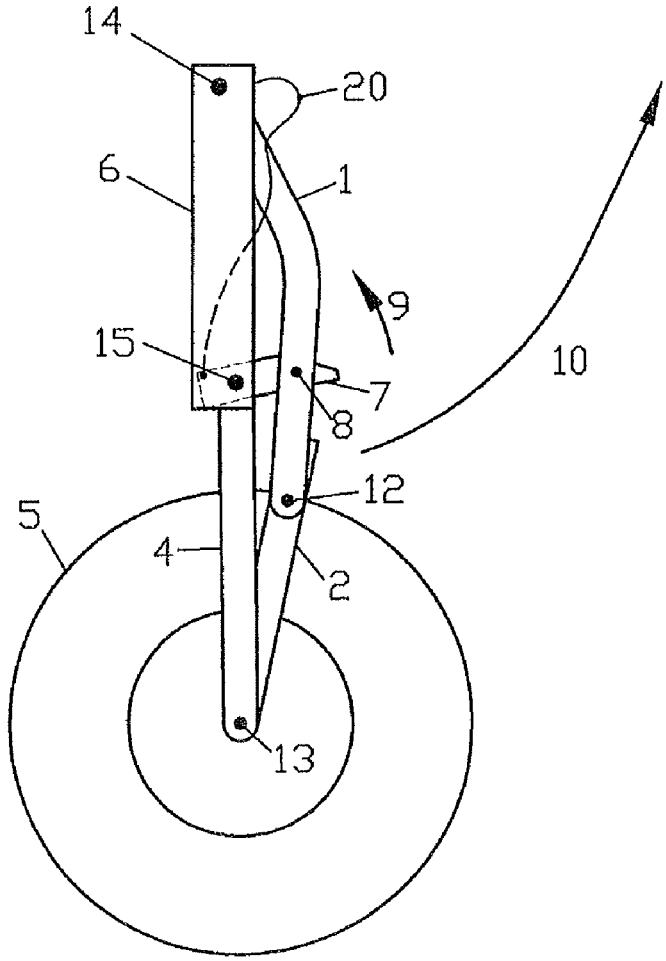
FIG. 11 is a side view of the retractable wheel assembly of FIG. 8 shown in an extended locked position with an optional lanyard.
Figure 12:
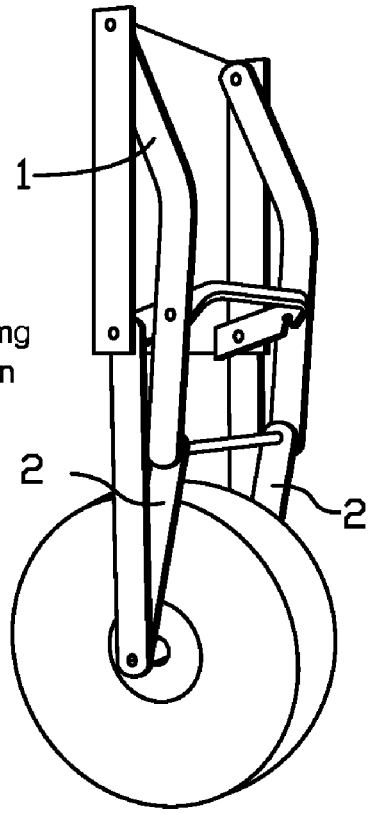
FIG. 12 is a perspective view of a retractable wheel assembly according to an alternative embodiment which shows first and second over centre locking arms being integral and forming a U-shaped member.
Figure 13:
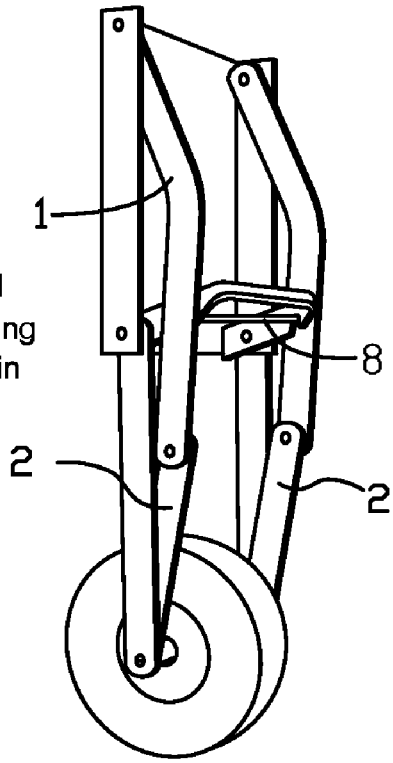
FIG. 13 is a perspective view of a retractable wheel assembly according to an alternative embodiment which shows first and second over centre locking arms being integral and forming an H-shaped member.
Figure 14:
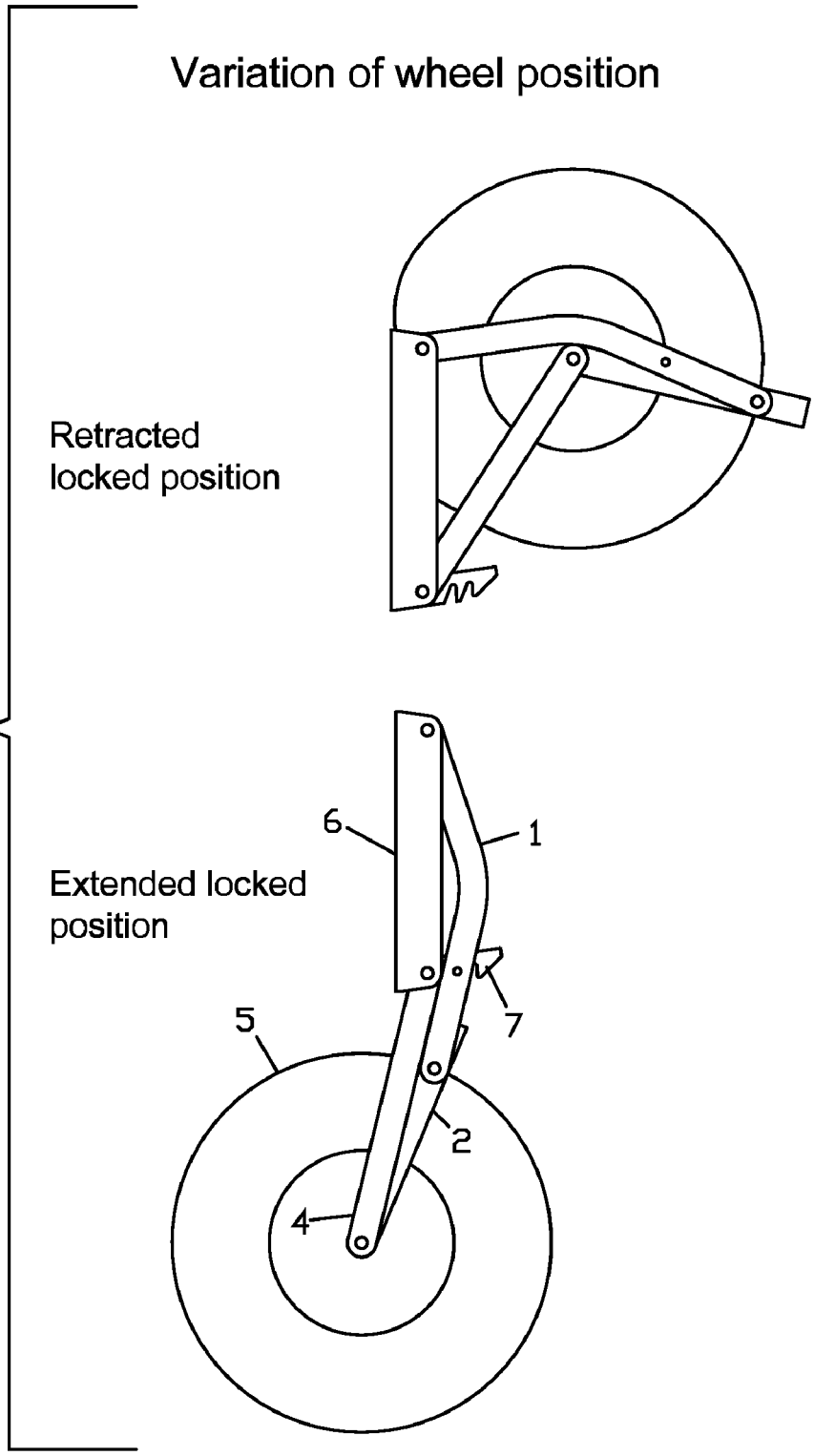
FIG. 14 is a side view of a retractable wheel assembly according to an alternative embodiment which shows a rotatably mounted catch comprising more than one notch.

Preferably the locking means is able to be disengaged using one hand. Optionally a lanyard 20 can be attached to the locking means (FIG. 6 and FIG. 11). Automated or semi-automated actuation means may also be provided.

Figure 3:
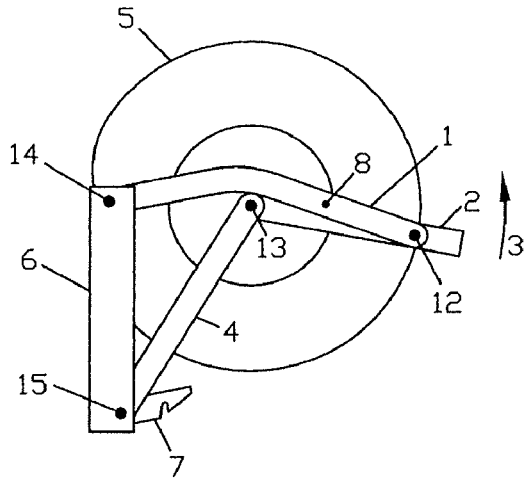
FIG. 3 is a side view of the retractable wheel assembly of FIG. 2 shown in a fully retracted locked position.
Figure 4:
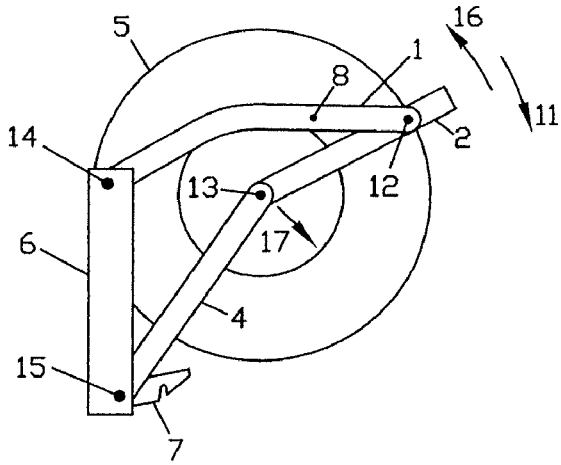
FIG. 4 is a side view of the retractable wheel assembly of FIG. 2 shown in a retracted but unlocked position.
Figure 5:
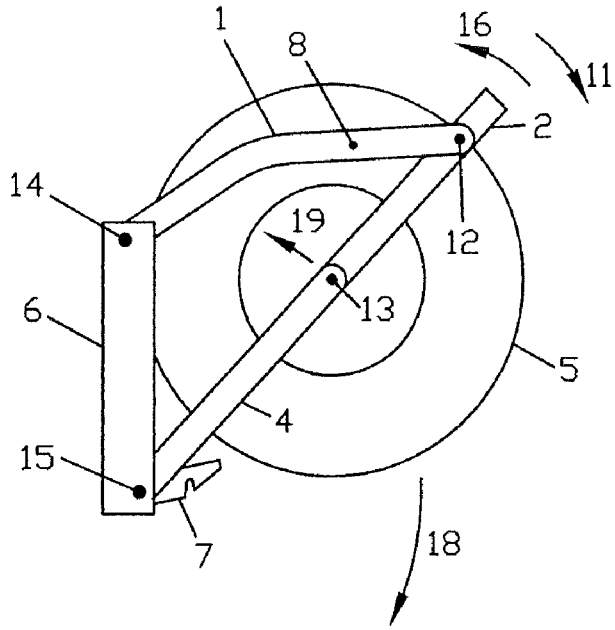
FIG. 5 is a side view of the retractable wheel assembly of FIG. 2 shown in a transitional position (partly extended or retracted).

With reference to FIGS. 3, 4, 5 and 6, four side views are provided of the retractable wheel assembly. FIG. 3 shows the retractable wheel assembly in the fully retracted locked position. FIG. 4 shows the retractable wheel assembly in the retracted unlocked position. FIG. 5 shows the retractable wheel assembly in the transitional position. FIG. 6 shows the retractable wheel assembly in the extended locked position.

To move the retractable wheel assembly from the fully retracted locked position (FIG. 3) to the extended locked position (FIG. 6) the link arm handle(s) 2 is moved in an upward direction 3 rotating the over-centre locking arm(s) 1 about fourth coupling point(s) 14. This causes third coupling point(s) 12 to move until the second coupling point(s) 13 is below a reference line extending between the third and fourth coupling points 12, 14. This and the release of any compression off the wheel 5, when present, from against the mounting bracket 6, when present, or the object to which the retractable wheel assembly is mounted, places the retractable wheel assembly in the retracted unlocked position (FIG. 4). As the link arm handle(s) 2 (FIG. 4) continues in a substantially upward direction 16 it causes second coupling point(s) 13 to move in a substantially downward direction 17 until the retractable wheel assembly is in the transitional position (FIG. 5). A wheel 5, when present, is then free to be lowered by moving it in a substantially downward direction 18 by applying force to the link arm handle(s) 2 until the locking means are engaged (e.g. spring loaded catch(es) engages with the locking pin(s) 8).

When the bottom of the boat is resting on land, the wheels can be easily extended by one person by simply unlocking the retractable wheel assemblies from the retracted position and then lifting the stern of the boat. The wheels will fall and the mechanism may lock automatically in the extended position under gravity.

To move the retractable wheel assembly from the extended locked position (FIG. 6) to the fully retracted locked position (FIG. 3) the locking means is first released. In the preferred embodiment shown, the over-centre locking arm(s) 1 (FIG. 6)

are released by lifting 9 the spring loaded pivotal catch(es) 7 thereby disengaging the spring loaded pivotal catch(es) from the locking pin(s) 8.

The link arm handle(s) 2 is then lifted in an upward direction 10 raising the wheel 5, when present, and moving the retractable wheel assembly to the transitional position (FIG. 5). The link arm handle(s) 2 is then moved in a downward direction 11 causing second coupling point(s) 13 to move in an upward direction 19 placing the retractable wheel assembly in the retracted unlocked position (FIG. 4). The link arm handle(s) 2 is then moved further down 11 until the over-centre locking arm(s) 1 abut the ends of the wheel strut(s) 4 and/or the locking pin(s) 8 contact the link arm handle(s) 2 thereby stopping further travel of the link arm handle(s) in the downward direction. At which point the third coupling point(s) 12 has passed over the centre of the second coupling point(s) 13 with respect to the fourth coupling point(s) 14 thereby compressing and locking the wheel 5, when present, against the mounting bracket 6, when present, or the object to which the retractable wheel assembly is mounted and thus placing the retractable wheel assembly in the fully retracted locked position (FIG. 3). In the retracted position a wheel, when present, may be neatly and robustly stowed in a compact shape which takes up little space on the transom of a boat. A wheel is stowed at a lower height relative to the mounting bracket than wheel assemblies of the prior art. The invention therefore allows for improved access and visibility around the boat, due to possibly none or less of the retractable wheel assembly and wheel protruding above the transom. However, this is dependent on user preferences. For example, it may be preferred to select a larger wheel rather than reduce obstruction.

As an option, to retract the wheels when the boat is underway afloat, locking means may be released, optionally by means of a lanyard 20 (FIG. 6) or other remote method, where upon the water flow and buoyancy forces acting on a wheel of suitable type will raise the wheel retracting mechanism approximately to the transitional position (FIG. 5) which is a lower drag position, allowing the boat to quickly achieve high speed. This is an advantage when launching the boat from a shoreline with breaking surf when speed is required to safely get the boat beyond the surf-line in the short period of calm water between waves. When safely beyond the surf-line the wheels may be locked in the retracted position (FIG. 3) as described previously.

The size of the components of the retractable wheel assembly can be varied to accommodate different size wheels.

The length and length ratio of components of the retractable wheel assembly can be varied to alter the position of the wheel when extended and retracted. For example the configuration may be varied to alter the retracted or extended positions. A variation of the extended position can be preferable to place the wheel further underneath the object to bear more of the weight of the object.

Thus it can be seen that at least the invention provides a retractable wheel assembly which is simple to operate, lightweight, compact when retracted and robust, has few moving parts and which uses up very little space on the transom of a boat.

It should be appreciated that any reference to a "rotatable coupling" or "rotatably coupled" or like term within the specification should be taken to mean a coupling which can be rotated within a plane. Preferably this is achieved with the use of pins, but may be achieved for example, with bolt and nut or screw attachment. It should be appreciated that a person skilled in the art will be able to provide other coupling means which meet this objective.

It should be appreciated that any reference to a "boat" within the specification should be taken to mean a boat, dinghy, or any other vessel which is required to be launched from the land into the water (for example sea, river or lake) or transported from the water to land.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Wherein the foregoing description reference has been made to specific components or integers of the invention having known equivalents then such equivalents are herein incorporated as if individually set forth.

It should be noted that various changes and modifications to the presently preferred embodiments described herein will be apparent to those skilled in the art. Such changes and modifications may be made without departing from the spirit and scope of the present invention and without diminishing its attendant advantages. It is therefore, intended that such changes and modifications be included within the present invention.

Thus, although there have been described particular embodiments of the present invention of a new and useful Retractable wheel assembly it is not intended that such references be construed as limitations upon the scope of this invention except as set forth in the following claims.

What is claimed is:

1. A retractable wheel assembly for coupling to a mounting on an object, the retractable wheel assembly being moveable between one or more extended position(s) and a retracted position, wherein in the extended position(s) the retractable wheel assembly is configured to expose a wheel and to stow said wheel in the retracted position, the retractable wheel assembly comprising:

a first wheel strut rotatably coupled to a first mounting at or proximate a first end of the first wheel strut, a first link arm handle rotatably coupled at or proximate a second end of the first wheel strut, and a first over-centre locking arm rotatably coupled at or proximate a first end of the first over-centre locking arm to the first link arm handle and rotatably coupled to a second mounting at or proximate a second end of the first over-centre locking arm, wherein the retractable wheel assembly is configured to rotatably couple to the wheel at or proximate the coupling between the first wheel strut and the first link arm handle, wherein the retractable wheel assembly is configured such that the first over-centre locking arm must move in both first and second directions about the second mounting as the assembly is moved from any one of the said one or more extended position(s) to the retracted position or from the retracted position to any one of the said one or more extended position(s), wherein the first and second directions are substantially opposing.

2. The retractable wheel assembly of claim 1, comprising said wheel.

3. The retractable wheel assembly of claim 1, comprising an elastic means arranged to releasably lock the retractable wheel assembly in the retracted position.

4. The retractable wheel assembly of claim 3, comprising said wheel, wherein the elastic means comprises at least a portion of the wheel.

5. The retractable wheel assembly of claim 1, comprising a common axle or axis of rotation for the wheel coupling and the coupling between the first wheel strut and the first link arm handle.

6. The retractable wheel assembly of claim 1, wherein the first mounting is fixed spatially relative to the second mounting.

7. The retractable wheel assembly of claim 1, wherein the coupling between the first link arm handle and the first over-centre locking arm is below a reference line extending through the second mounting and the coupling between the first wheel strut and the first link arm handle when in the retracted position and wherein in use, the second mounting is positioned above the first mounting.

8. The retractable wheel assembly of claim 1, wherein when the retractable wheel assembly is moved between the retracted position and the extended position(s) the angle between the points defined by:

the second mounting, the rotational coupling between the first wheel strut and the first link arm handle, and the rotational coupling between the first link arm handle and the first over-centre locking arm, moves from being greater than substantially 180° to less than substantially 180° or less than substantially 180° to greater than substantially 180°.

9. The retractable wheel assembly of claim 1, wherein when in the retracted position the first wheel strut abuts the first over-centre locking arm.

10. The retractable wheel assembly of claim 1, comprising a means for releasably securing the retractable wheel assembly in any one of the said one or more extended position(s).

11. The retractable wheel assembly of claim 10, wherein the means for releasably securing the retractable wheel assembly in any one of the said one or more extended position(s) comprises a first rotatably mounted catch configured to engage a locking means.

12. The retractable wheel assembly of claim 11, wherein the first rotatably mounted catch comprises one or more notches configured to engage one or more locking pins of the locking means.

13. The retractable wheel assembly of claim 12, wherein the one or more locking pins are coupled to or integral to the first over-centre locking arm.

14. The retractable wheel assembly of claim 11, comprising a second wheel strut rotatably mounted at or proximate a first end thereof, and configured to cooperate with the first wheel strut to improve structural rigidity, and/or a second link arm handle configured to cooperate with the first link arm handle to improve structural rigidity, and/or a second over-centre locking arm rotatably mounted at or proximate one end thereof and configured to cooperate with the first over-centre locking arm to improve structural rigidity, and/or a second rotatably mounted catch to improve structural rigidity and engagement with the locking means.

15. The retractable wheel assembly of claim 14, wherein the second wheel strut is substantially parallel to the first wheel strut and/or the second link arm handle is substantially parallel to the first link arm handle and/or the second over-centre locking arm is substantially parallel to the first over-centre locking arm and/or the second rotatably mounted catch is substantially parallel to the first rotatably mounted catch, with respective same or corresponding couplings provided therebetween.

16. The retractable wheel assembly of claim 14, wherein the second link arm handle is integral to the first link arm handle forming a substantially U-shaped member and/or the second rotatably mounted catch is integral to the first rotatably mounted catch forming a substantially U-shaped member and/or the second over-centre locking arm is integral to the first over-centre locking arm.

17. The retractable wheel assembly of claim 10, wherein the means for releasably securing the retractable wheel assembly in any one of the said one or more extended position(s) is rotatably coupled on an axis of rotation in common with the first mounting.

18. The retractable wheel assembly of claim 1, comprising a mounting bracket adapted to mount the retractable wheel assembly on an object, wherein the mounting bracket is configured to mount to or include the first and second mountings.

19. The retractable wheel assembly of claim 18, wherein in the retracted position the wheel abuts the mounting bracket.

20. The retractable wheel assembly of claim 1, comprising:

a second wheel strut rotatably mounted at or proximate a first end thereof, and configured to cooperate with the first wheel strut to improve structural rigidity, and/or a second link arm handle configured to cooperate with the first link arm handle to improve structural rigidity, and/or a second over-centre locking arm rotatably mounted at or proximate one end thereof and configured to cooperate with the first over-centre locking arm to improve structural rigidity.

21. The retractable wheel assembly of claim 20, wherein in the retracted position the wheel is at least partly contained within the first wheel strut, the first link arm handle and the first over-centre locking arm and at least one of the second wheel strut, the second link arm handle and the second over-centre locking arm.

22. The retractable wheel assembly of claim 20, comprising a mounting bracket adapted to mount the retractable wheel assembly on an object, wherein the mounting bracket is configured to mount the first link arm handle and the first over-centre locking arm, and at least one of the second link arm handle and the second over-centre locking arm.

23. The retractable wheel assembly of claim 1, wherein in the retracted position the wheel is at least partly contained within the wheel strut(s), locking arm handle(s) and over-centre locking arm(s).

* * * * *